United States Patent [19]

Yoshieda et al.

[11] Patent Number: 4,615,246

[45] Date of Patent: Oct. 7, 1986

[54] METHOD OF CUTTING A SLIDE FASTENER CHAIN

[75] Inventors: Keiichi Yoshieda, Kurobe; Toshiaki Sodeno, Toyama; Syuichi Honmoto, Uozu, all of Japan

[73] Assignee: Yoshida Kogyo K. K., Tokyo, Japan

[21] Appl. No.: 763,626

[22] Filed: Aug. 8, 1985

[30] Foreign Application Priority Data

Aug. 14, 1984 [JP] Japan ..... 59-169657

[51] Int. Cl.[4] ..... B65H 17/36

[52] U.S. Cl. ..... 83/42; 83/18; 83/251; 83/277; 83/921

[58] Field of Search ..... 83/921, 42, 18, 251, 83/277; 29/408–410

[56] References Cited

U.S. PATENT DOCUMENTS 3,714,698 2/1973 Fukuroi ..... 29/408
4,250,781 2/1981 Nakamura ..... 83/277 X
4,524,656 6/1985 DelFabro et al. ..... 83/277 X

FOREIGN PATENT DOCUMENTS 49-44243 11/1974 Japan .

*Primary Examiner*—Frank T. Yost
*Attorney, Agent, or Firm*—Hill, Van Santen, Steadman & Simpson

[57] ABSTRACT

In a method of cutting a continuous slide fastener chain into individual slide fastener lengths, the fastener chain is tensioned between its leading end and a succeeding element-free portion as they are gripped by downstream and at upstream grippers, respectively, at a specified point and a cutting station spaced upstream therefrom along a horizontal straight path by a varying distance corresponding to the length of a prospective individual slide fastener. Then the tension of the individual slide fastener length of the chain is relaxed by slightly moving the downstream gripper from the specified point toward the upstream gripper which is kept stationary at the cutting station, whereupon the fastener chain is cut transversely across the succeeding one element-free portion.

2 Claims, 6 Drawing Figures

METHOD OF CUTTING A SLIDE FASTENER CHAIN

BACKGROUND OF THE INVENTION

1. Field of the Invention

The present invention relates to the production of slide fasteners, and more particularly to a method of cutting a continuous slide fastener chain into individual slide fastener lengths.

2. Description of the Prior Art

In the art of cutting a continuous slide fastener chain into individual slide fastener lengths, it is known that the fastener chain is pulled forwardly beyond a cutting station by a downward gripper to an extent corresponding to an individual slide fastener length and is then cut transversely across a succeeding one of longitudinally spaced successive element-free portions by a pair of scissors while such individual fastener length of the fastener chain is kept in a state of tension by the downstream gripper in cooperation with an upstream gripper. A common problem with this prior art method is that the degree of tension of the stringer tape would vary little by little as the cutting progresses from one edge to the other across the fastener chain, thus providing unsightly tape ends that are not straight and/or perpendicular to the longitudinal tape edges. This prior art is exemplified by Japanese Patent Publication (Tokkosho) No. 49-44243.

SUMMARY OF THE INVENTION

In the present method, a continuous slide fastener chain is tensioned between its leading end, or a leading element-free portion, and a succeeding element-free portion as they are gripped by downstream and upstream grippers at a specified point and a cutting station spaced apart upstream therefrom along a horizontal path by a varying distance corresponding to the length of a prospective individual slide fastener. Then the tension of the individual slide fastener length of the chain is relaxed by slightly moving the downstream gripper from the specified point toward the upstream gripper kept stationary at the cutting station, whereupon the fastener chain is cut transversely across the succeeding element-free portion.

It is therefore an object of the present invention to provide a method of cutting a continuous slide fastener chain into required slide fastener lengths with accuracy.

Another object of the invention is to provide a method of cutting a continuous slide fastener chain into individual slide fastener lengths, in which each cutting can take place across a continuous stringer tape along a straight cutting line perpendicular to opposite longitudinal edges of the tape, thus guaranteeing sightly slide fasteners.

A further object of the invention is to provide a method of cutting a continuous slide fastener chain into individual slide fastener lengths, without producing any flip of the fastener chain, so that the resultant stringers can be delivered in an orderly fashion to a subsequent station where, for instance, a pair of the stringers are coupled together.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

A cycle of progressive steps of the present method is illustrated in FIGS. 1A through 1E, in which a single slide fastener stringer of a continuous length (hereinafter referred to as "continuous slide fastener chain") is used as a material to be cut, the fastener stringer having longitudinally spaced successive element-free portions. Alternatively, a pair of continuous slide fastener stringers in uncoupled state may be used, as shown in FIG. 2.

Figures 1A, 1B, 1C, 1D, 1E:
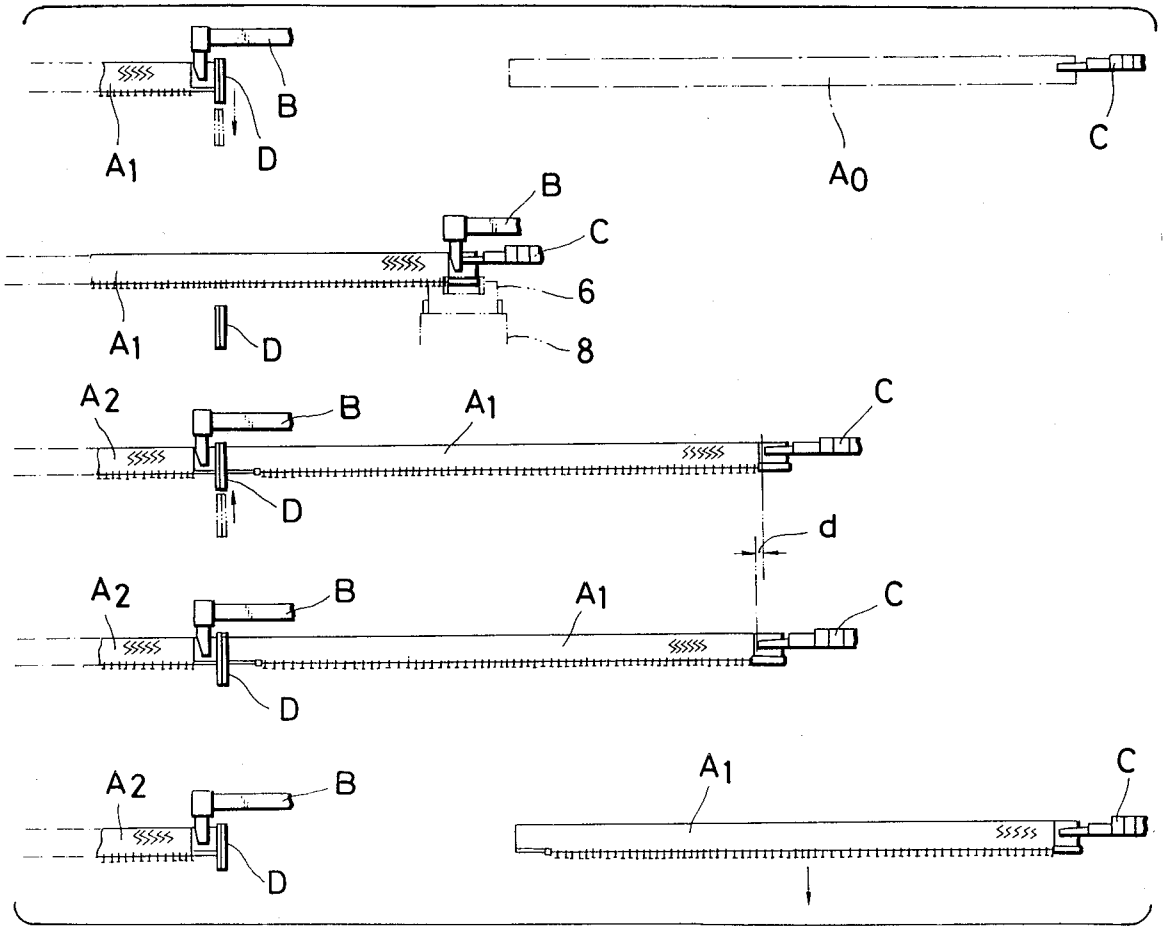
FIGS. 1A through 1E show a cycle of progressive cutting steps the present method.
Figure 2:
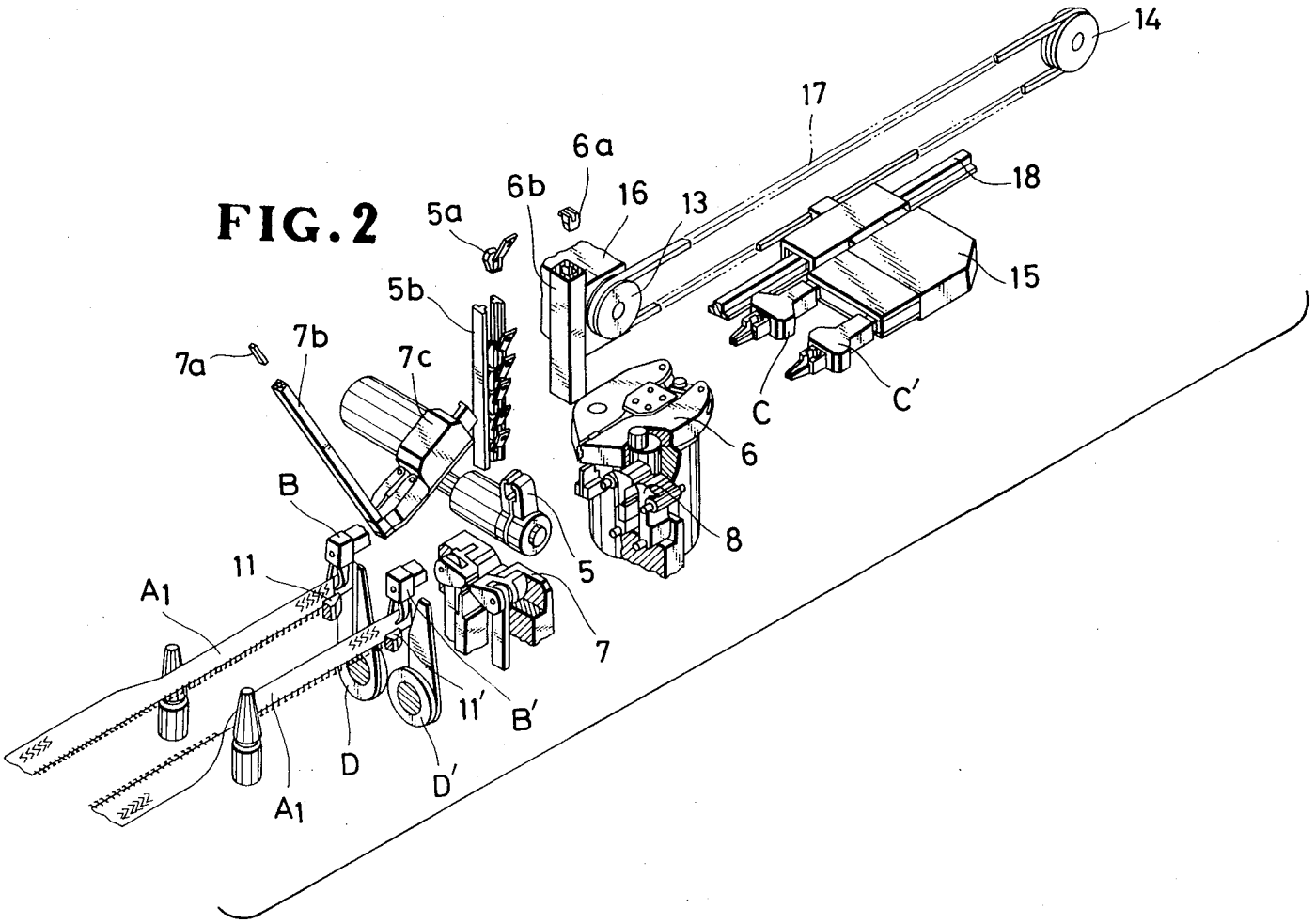
FIG. 2 is a perspective view, with parts broken away, of a slide-fastener finishing apparatus in which the present method is carried out.

FIG. 1A shows a preceding piece of the fastener chain $A_0$ of the individual slide fastener length (indicated in dash-and-dot lines) that has been cut by a cutter D and then has been pulled forwardly (rightwardly) therefrom along a substantially horizontal straight path by a second or downstream gripper C to a discharging station, during which time a leading end, or a leading one of the successive element-free portions, of the fastener chain $A_1$ is kept stationary at a cutting station as gripped by a first gripper B. The cutter D is then retracted from the fastener chain $A_1$.

Then the fastener chain $A_1$ is pulled forwardly along the path by the first gripper B until the leading end of the fastener chain $A_1$ arrives at a transit station where the gripping of the fastener chain's leading end is transferred from the first gripper B to the second gripper C, as shown in FIG. 1B. Preferably, a pin and/or a box (of a separable bottom end assembly) may be attached to the leading end of the fastener chain $A_1$ by means of a pin holder 6 and a punch 8 (both described below in connection with FIG. 2) as the leading chain end approaches the transit station.

As shown in FIG. 1C, the fastener chain $A_1$ is further pulled forwardly from the transit station along the path by the second gripper C until its leading end arrives at a specified point spaced apart downstream from the cutting station by a varying distance corresponding to the length of a prospective individual slide fastener, that is, until a succeeding one of the element-free portions arrives at the cutting station, by which time the first gripper B returns thereto from the transit station to grip the succeeding element-free portion upon arrival thereof. The fastener chain $A_1$ is thus tensioned between its leading end and the succeeding element-free portion as gripped by the first and second grippers B and C.

Subsequently, with the leading end of the fastener chain $A_1$ gripped by the first gripper B and kept stationary at the cutting station, the tension of such individual slide fastener length of the fastener chain $A_1$ is relaxed by moving the second gripper C backwardly from the specified point along the path by a relatively small distance d (FIG. 1D), whereupon the fastener chain $A_1$ is cut transversely across the succeeding element-free portion. As a result, an individual slide fastener length of the fastener chain $A_1$ has been obtained.

Finally, as shown in FIG. 1E similar to FIG. 1A, such individual slide fastener length of the fastener chain $A_1$ is moved forwardly by the second gripper C to the discharging station from which the fastener chain $A_1$ is delivered to a subsequent station where, for instance, a pair of the fastener stringers of the slide fastener length is coupled together. Meanwhile, the leading end of the remaining fastener chain $A_2$ is at rest in the cutting station as gripped by the first gripper B and is thus in condition ready for the next cycle of progressive cutting steps.

Throughout a complete cycle of the progressive cutting steps of FIGS. 1A–1E, the fastener chain assumes an upright posture with the coupling elements directed downwardly.

FIG. 2 illustrates a separable-slide-fastener finishing apparatus in which a pair of uncoupled continuous fastener stringers or chains $A_1$, $A_1$ is cut into individual slide fastener lengths according to the present method.

In the finishing apparatus, a pair of the fastener chains $A_1$, $A_1$, with coupling elements directed downwardly, is fed in parallel relation along a substantially horizontal straight path to the cutting station, immediately upstream of which a pair of stops 11, 11' is disposed to terminate the movement of the fastener chains $A_1$, $A_1$ upon arrival of their leading ends, or their leading element-free portions, precisely at the cutting station. Upon this arrival, the leading ends of the respective fastener chains $A_1$, $A_1$ are gripped by a pair of first grippers B, B'.

The fastener chains $A_1$, $A_1$ are then pulled forwardly along the chain path by the first grippers B, B' to the transit station where the gripping of the leading ends of the fastener chains $A_1$, $A_1$ are transferred from the first grippers B, B' to a pair of second grippers C, C'. During that time, a slider 5*a* from a slider chute 5*b* is threaded onto one of the fastener chains $A_1$ by a slider holder 5, and then a box 6*a* with a box pin from a box chute 6*b* is threaded onto the leading end of the one fastener chain $A_1$ by a box holder 6. Upon completion of this threading, the movement of the one fastener chain $A_1$ is stopped, and the box 6*a* together with the box pin is crimped onto the tape by a punch 8.

In the meantime, a pin 7*a* from a pin chute 7*b* is threaded onto and pre-crimped onto the leading end of the other fastener chain $A_1$ by a pin holder 7*c*, and the thus pre-crimped pin 7*a* is further crimped by the punch 8.

Then the fastener chains $A_1$, $A_1$ are further pulled forwardly along the chain path by the second grippers C, C' until the leading ends of the fastener chains $A_1$, $A_1$ arrive at a specified point spaced downstream from the cutting station by a varying distance corresponding to the length of a prospective individual slide fastener, that is, until the succeeding coupling element arrives at the cutting station, by which time each first gripper B, B' returns thereto from the transit station to grip the succeeding element-free portion of the respective fastener chain $A_1$ upon arrival thereof. Each fastener chain $A_1$ is thus tensioned between its leading end and the succeeding element-free portion as gripped by the respective second gripper C, C' and the respective first gripper B, B'.

Subsequently, with the prospective leading end of each fastener chain $A_1$ gripped by the respective first gripper and as kept stationary at the cutting station, the tension of such individual slide fastener length of each fastener chain $A_1$ is relaxed by moving the respective second gripper C, C' backwardly from the specified point along the chain path by a relatively small distance d (FIG. 1D), whereupon each fastener chain $A_1$ is cut transversely across the succeeding element-free portion by the respective cutter D, D'.

The second grippers C, C' are carried by a base 15 slidably mounted on a rail 18 parallel to the chain path. The base 15 is fixed to an endless belt 17 wound about a pair of pulleys 13, 14, one of which is driven by a motor 16 for rotation in opposite directions. Thus in response to the rotation of the pulleys 13, 14, the second grippers C, C' are moved forwardly or backwardly along the chain path, depending on the direction of the rotation of the pulleys 13, 14.

One of various advantageous results according the present method is that since the fastener chain is free from tension during cutting, it is possible to cut the fastener chain without in a resulting flipping of the fastener chain occuring so that the resultant fastener stringers can be delivered in an orderly fashion to a subsequent station where, for instance, a pair of the stringers are coupled together.

Another advantage of the present method is that each cutting can take place across the stringer tape along a straight cutting line perpendicular to the opposite longitudinal tape edges. As a consequence, the fastener chain can be cut into required slide fastener lengths with accuracy, guaranteeing sightly slide fasteners.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of cutting a continous slide fastener chain into individual slide fastener lengths, the fastener chain having longitudinally spaced successive element-free portions, said method comprising the steps of:

(a) gripping a leading end of the fastener chain at a cutting station by a first gripper movable between the cutting station and a transit station along a substantially horizontal straight path;

(b) pulling the fastener chain forwardly along the path by the first gripper until the leading end of the fastener chain arrives at the transit station;

(c) at the transit station, transferring the gripping of the leading end of the fastener chain from the first gripper to a second gripper movable along the path between the transit station and a specified point and spaced downstream therefrom by a varying distance corresponding to the length of a prospective individual slide fastener;

(d) pulling the fastener chain forwardly along the path by the second gripper until a succeeding one of the element-free portions arrives at the cutting station, by which time the first gripper has returned to the cutting station to grip the succeeding element-free portion;

(e) with the succeeding element-free portion gripped by the first gripper and kept stationary at the cutting station, pulling the fastener chain on the leading end thereof by the second gripper until the leading end of the fastener chain arrives at said specified point, at which time such individual slide fastener length of the fastener chain is in a state of tension;

(f) then relaxing the tension of the slide fastener length of the fastener chain by slightly moving the second gripper backwardly from said specified point toward the first gripper kept stationary at the cutting station; and (g) finally, cutting the fastener chain transversely across the succeeding element-free portion to thereby provide an individual slide fastener length of the fastener chain.

2. A method according to claim 1, wherein the fastener chain assumes an upright posture with coupling elements directed downwardly, during the time that the successive steps (a) through (g) take place.

* * * * *